United States Patent [19]

Schauffele

[11] 4,445,306

[45] May 1, 1984

[54] MECHANICALLY ATTACHED ROOFING SYSTEM

[75] Inventor: Roy F. Schauffele, Carlisle, Pa.

[73] Assignee: Carlisle Corporation, Cincinnati, Ohio

[21] Appl. No.: 385,058

[22] Filed: Jun. 4, 1982

[51] Int. Cl.[3] ..... E04B 5/00

[52] U.S. Cl. ..... 52/410; 52/467

[58] Field of Search ..... 52/410, 469, 417, 521, 52/466, 467, 408, 716

[56] References Cited

U.S. PATENT DOCUMENTS

| | | | |
|---|---|---|---|
| 993,686 | 5/1911 | Howard . | |
| 1,358,863 | 11/1920 | McConnell | 52/467 |
| 1,544,866 | 7/1925 | Slater . | |
| 1,724,601 | 9/1924 | Kellogg | 52/467 |
| 1,924,382 | 11/1931 | Schemmel | 52/716 |
| 2,143,695 | 12/1937 | Hill | 52/716 |
| 4,028,856 | 6/1977 | Dalbec | 52/281 |
| 4,059,933 | 11/1977 | Funk et al. . | |
| 4,074,501 | 2/1978 | Sandqvist . | |

*Primary Examiner*—John E. Murtagh
*Assistant Examiner*—Kathryn L. Ford
*Attorney, Agent, or Firm*—Wood, Herron & Evans

[57] ABSTRACT

A system for mechanically attaching a flexible waterproof membrane to an underlying roof structure including an elongated fastening bar which is placed above the membrane and fastened to the roofing structure with fasteners, such as screws or nails, which are driven through the bar from the top thereof through the underlying membrane and into the roof structure, and an elongated waterproof strip having (a) a central region sandwiched beneath the bottom of the bar and the membrane, and through which the fastening screws or nails also pass, and (b) marginal regions which wrap upwardly around the bar and overlap each other above the bar and the heads of the fasteners, providing a waterproof seal for the bar with a double thickness layer of strip material above the fastener heads.

14 Claims, 6 Drawing Figures

MECHANICALLY ATTACHED ROOFING SYSTEM

This invention relates to roofing systems, and more particularly to a roofing system in which a flexible waterproof membrane placed on an underlying roofing structure is mechanically secured thereto without the aid of adhesive between the membrane and the roof structure.

In one common form of roofing system, a singleply of waterproof membrane or sheet, for example, ethylene propylene diene monomer (EPDM) rubber, is placed on top of a flat roof structure. The single-ply roof membrane is supplied in rolls having a width of approximately 40 feet. In use, the membrane is unrolled on the roof and positioned in place. Appropriate splices are made at the edges of adjacent sheets and suitable flashing provided at curbs, skylights, vent pipes, and the like, all in a manner well known in the art.

To secure the membrane to the roof structure, three fundamentally different approaches have heretofore been taken. In accordance with one approach, known as the "adhered" roofing system, adhesive is applied to the entire roof and used to fasten the lower surface of the membrane and the upper surface of the roof structure. The use of adhesive in this manner is a time-consuming and, therefore, expensive membrane-fastening method. In a second approach, known as the "ballasted" system, the membrane is placed on the roof structure without adhesive therebetween, that is, "loosely laid", and the membrane held in position by a layer of gravel placed on top of it. The disadvantage of this scheme is it adds unnecessary weight to the roof. In accordance with a third approach, known as a "mechanically attached" roofing system, elongated metal or plastic nailing strips having adhesive applied to the bottoms thereof are placed on top of the membrane at periodic spaced intervals, much like a grid, and secured in place by driving fasteners through the nailing strip and membrane into the underlying roof structure.

In mechanically attached roofing systems using nailing strips, the fasteners penetrate the membrane. As a consequence, it has been necessary to apply a caulking or sealing compound over the head of each fastener to seal the interface between the fastener and the nailing strip in the region of the fastener head. This aids in retaining the waterproof integrity of the membrane notwithstanding penetration at spaced intervals by the fasteners which hold the nailing strips, and hence the membrane, in place on the roof structure. While mechanically attached roofing systems of the nailing strip type do not have the disadvantages of the adhered and ballasted systems, the need to apply adhesive to the bottom of the nailing strip as well as seal each fastener head following fastening to the roof structure, has been less than entirely satisfactory. For example, fastener heads sealed with caulking compound constitute a potential leakage site, and, considering there are several thousand fasteners per roof, can amount to a significant problem.

Accordingly, it has been an objective of this invention to provide a mechanically attached roof system which is easier to install and provides more secure moisture-proof sealing of the fastener heads than prior art nailing strips. This has been accomplished in accordance with certain of the principles of this inveniton by providing, in combination, and elongated resilient plastic fastening bar and an elongated self-adhering compressible rubber strip, which strip has its central region compressively sandwiched between the bottom of the fastening bar and membrane and its opposite marginal edge regions wrapped upwardly around the fastening bar in overlapping relation above the fastener heads, totally enclosing the fastening bar and associated fastener heads, establishing a compressive gasket to form a watertight seal around the fasteners, and providing a double thickness protective layer above the major portion of the bar and fastener head. To promote a good seal between the overlapping marginal edges of the self-adhering rubber strip which overlie the upper surface of the bar and fastener heads, a weighted roller can be run along the top of the overlapped edges of the strip. The resulting pressure applied to the overlapped edges promotes a good bond therebetween to provide a long-lasting seal.

In a preferred form of the invention, the fastening bar has a flat bottom surface and a very slightly curved convex upper surface, providing a low profile which resists wind uplift and interferes minimally with drainage.

The mechanical attachment scheme of this invention requires neither adhesive application to the bottom of the fastening bar nor caulking of the individual fastener heads. Thus, it reduces application costs. Moreover, by reason of the manner in which the selfadhering strip is compressed and encircles the bar and fasteners, this invention provides a strong protective waterproof seal for the membrane in the region penetrated by the fasteners. Also, because the fastening bar is resilient, it conforms to irregularities in roof contour, assuring the watertight integrity of the roofing system notwithstanding such irregularities.

These and other features, advantages and objectives of the invention will be more readily apparent from a detailed description of the invention taken in conjunction with the drawings in which.

Figure 1:
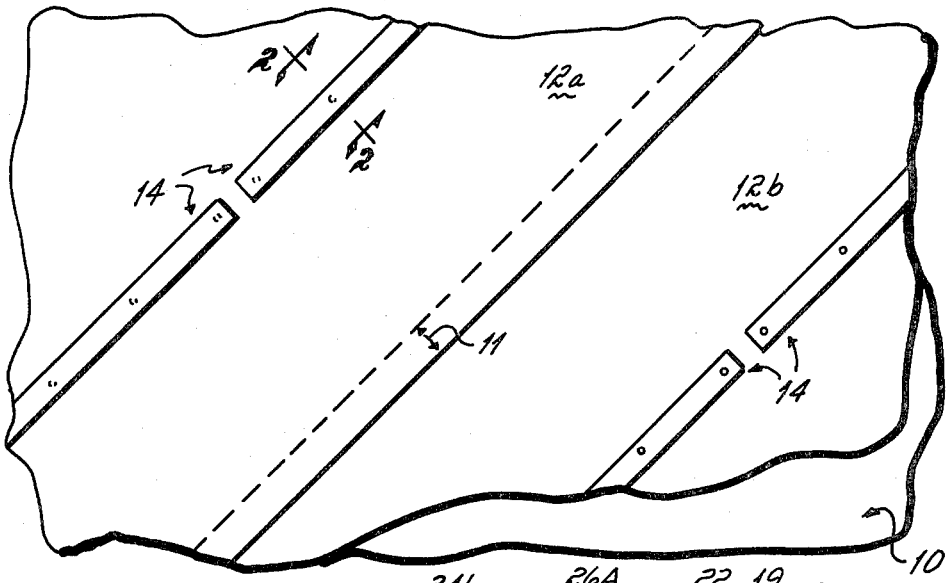
FIG. 1 is a top plan view of a flat roof structure on which a flexible waterproof membrane is positioned and mechanically attached to the underlying roof structure with the fastening system of this invention.

With reference to FIG. 1, a flat roof structure 10 is shown on which a flexible waterproof membrane 12 is located. The roof structure 10 may take any suitable form, such as, a metal or wood deck, or the like, with or without a layer of thermally insulating material or other suitable intermediate deck covering. The membrane 12 may also take a variety of forms, and may for example be EDPM rubber, butyl rubber, or the like. The membrane 12 is placed on the roof structure 10, such as by unrolling it from a suitable roll, and properly positioned with the edges thereof overlapping those of adjacent sheets. The lapped edges 11 of adjacent membrane sheets **12*a* and 12*b* are sealed to form a waterproof joint with an adhesive compatible with the membrane material. Aside from the ahesive used to seal the lapped edges 11 of adjacent sheets 12*a* and 12*b*, and adhesive which might be utilized to bond flashing (not shown) to the membrane in the area of curbs, skylights, vent pipes, and the like, none of which are shown, no adhesive is used to secure the membrane 12 to the underlying roof structure 10**, thereby accounting for the use of the term "loosely laid" to describe such a membrane.

Figure 2:
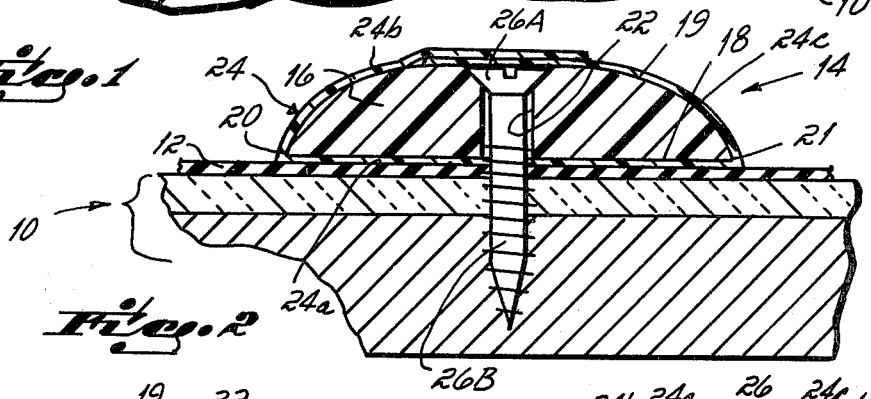
FIG. 2 is a sectional view along line 2–2 of FIG. 1.

To secure the "loosely laid" membrane 12 to the roof structure 10, the mechanical fastening bar assembly 14 of this invention is utilized. The fastening bar assembly 14, considered in more detail in connection with FIG. 2, includes elongated bar 16 of resilient plastic material such as polypropylene reinforced wth 5% glass fibers or glass-filled thermoplastic olefin or like material, which is noncorrosive, nonconductive electrically, and exhibits good weathering properties, including resistance to moisture, heat, sun and the like. The bar 16 has a flat bottom surface 18 and a slightly curved convex top surfae 19 which meet along opposite longitudinal edges 20 and 21. Preformed holes 22 are provided in the bar 16 along its longitudinal center line at periodic intervals such as every 12 inches. Typically, the fastening bars 16 are each approximately 10 ft. long, 2-½" wide, ¼" high, and generally hemi-elliptical in cross-section, although other sizes and shapes can be used.

Encircling the bar 16 is an elongated strip of waterproof flexible self-adhering plastic sheet material having a width approximately 2.5 times the width of the bar 16 and a thickness of approximately 0.075 inches. The strip 24 has a central portion 24A, which is sandwiched between and in intimate contact with the lower surface 18 of the bar 16 and the upper surface of the membrane 12 underlying the fastening bar. The strip 24 has opposite marginal edge regions 24B and 24C which wrap upwardly around the opposite edges 20 and 21 of the bar 16 into an overlapping relationship above the central longitudinal portion of the bar containing the fastener holes 22. The overlapped marginal edge regions 24B and 24C of the strip 24 are pressed into firm engagement with each other as well as with the upper surface 19 of the bar 16. Preferably, the strip 24 is fabricated of a compressible, self-adhering, uncured, butyl gum rubber stock which has sufficient tackiness to enable a good watertight bond to be formed between the overlapped portions of the edge regions 24B and 24C without the aid of adhesive.

Fasteners 26, such as screws having a head 26A and a shank 26B, are provided in each of the longitudinally spaced openings 22 to secure the bar 16 to the underlying deck or roof structure 10 in a manner which compresses the central region 24A of the strip such that it functions as a compression gasket to form a watertight seal around the fasteners, and in turn preserve the waterproof integrity of the membrane 12 notwithstanding penetration thereof by fasteners 26.

Figure 3A:
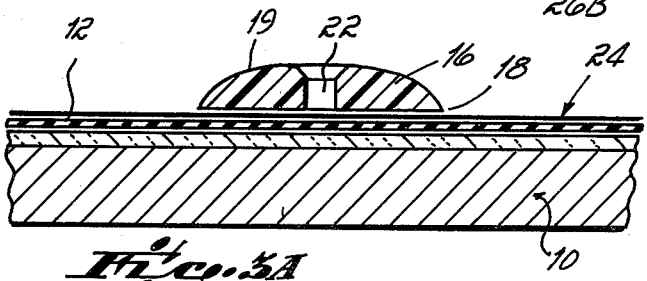
FIGS. 3A–3D are cross-sectional views similar to that of FIG. 2 showing the various steps in mechanically attaching a flexible waterproof membrane to an underlying roof structure using the fastening system of this invention.

In operation, after the membrane 12 has been loosely laid on the underlying deck structure 10, the fastening bars 16 with their associated gum rubber strips 24 are placed on the membrane 12 at the desired locations, as shown in FIG. 3A. The self-adhering strip 24 may be placed on the membrane 12 and the bar 16 thereafter placed atop the central portion 24A of the strip 24, or alternatively, the central portion 24A of the strip 24 may be first placed in contact with the bottom 18 of the bar 16 and adhered thereto, and the adhered bar and strip placed on top of the membrane 12.

Figure 3C:
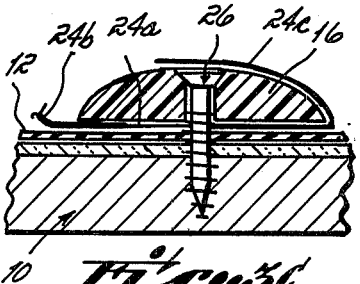
Figure 3B:
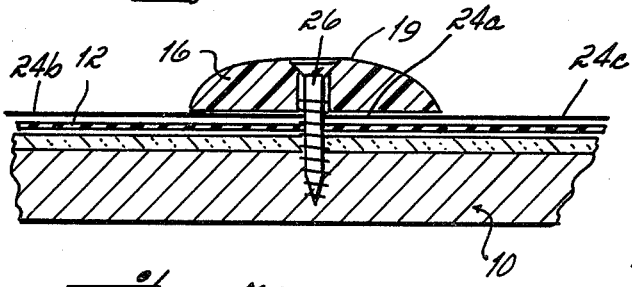

The fasteners 26 are then driven down through the bar 16, strip 24, and membrane 12 into the underlying deck assembly 10, as shown in FIG. 3B, to secure the bar 16 in place with the underlying central region 24A of the strip 24 compressed between the bar 16 and the underlying membrane-covered deck structure 10. Since neither strip 24 nor the membrane 12 are provided with preformed holes to receive the fastener shanks 26B, the openings in the strip 24 and membrane 12 made by the fastener 26 as it is driven downwardly into the underlying deck structure will tightly embrace the fastener shank, enhancing the watertight integrity of the roofing system provided by the compressed strip region 24A which, as noted, functions as a compression gasket to seal around the fastener shanks. Similarly, because the head 26A of the fasteners 26 are snugly engaged in the upper end of the preformed openings 22 in the bar 16, the watertight integrity of the roofing system is further improved.

Figure 3D:
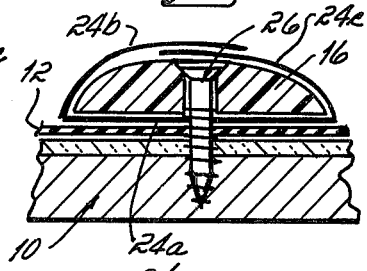

After the bar 16 has been securely fastened in place with the fasteners 26, one of the edges, such as edge 24C, of the strip 24 is wrapped upwardly around the bar 16 in contact with the top 19 of the bar and fastener heads 26A, as shown in FIG. 3C. After this has been done, the other edge 24B is wrapped upwardly around the other edge 20 of the bar 16 into overlapping contacting relationship with the marginal edge 24C, as shown in FIG. 3D. Preferably, the marginal edges 24B and 24C are sized such that the overlapped region therebetween occurs above the heads 26A of the fasteners, providing a protective layer thereover of double thickness.

The overlapping edges 24B and 24C of the strip 24 are then firmly pressed into an engagement with each other and with the top 19 of the bar 16, to enhance the bond therebetween, such as by rolling a weighted roller longitudinally along the fastener assembly along the center line of the bar 16 in which the fasteners 26 are positioned.

Due to the convex profile of the bar 16, the fastener assembly of this invention effectively resists uplift due to wind. Similarly, due to the low profile of the bar, the fastener assembly 16 does not significantly impede drainage of the roof. Finally, by reason of the strip 24 totally encircling the bar 16 and the fastener heads 26 and being compressed in the region between the bar and membrane 12, the waterproof integrity of the membrane 12 is retained notwithstanding penetration by fasteners 26. Finally, by reason of the fact the bar 16 is fabricated of resilient plastic, it is lightweight, noncorrosive, electrically nonconductive, and conforms well to irregularities in deck contour, all of which promote a long-lasting, trouble-free, waterproof roof.

What is claimed is:

1. A system for mechanically attaching a waterproof membrane to a roof structure upon which the membrane is positioned, comprising:

an elongated fastening bar having bottom and top surfaces separated by spaced parallel longitudinal edges, said bar being positionable above said membrane with said bottom surfae lowermost, an elongated waterproof strip having a length coextensive with that of said bar, said strip having an elongated intermediate region disposed between elongated marginal regions, said strip being positioned with said intermediate region located between said bar and said membrane in underlying relation to said bottom surface and with said marginal regions at least partially overlapping each other above said top surface, whereby said bar is fully encircled by said strip, and a plurality of fasteners each having an integral head and shank, said fasteners having their respective heads proximate said top surface of said bar in underlying relation to at least one of said encircling marginal regions and their respective shanks extending through said bar, intermediate region of said strip and membrane into said roof structure to anchor said bar to said roof structure with said intermediate region of said strip and underlying membrane sandwiched therebetween.

2. The system of claim 1 wherein said top surface of said bar is convex and said overlapping marginal regions shaped to conform to said convex top surface, minimizing wind uplift.

3. The system of claim 2 wherein said bottom surface is substantially planar to maximize contact between said strip and said overlying bar and underlying membrane, and thereby enhance the waterproof integrity of said membrane notwithstanding penetration thereof by said fasteners.

4. The system of claim 1 wherein said bar is resilient plastic.

5. The system of claim 1 wherein said bar has a plurality of longitudinally spaced preformed holes therethrough interconnecting said top and bottom surfaces for receiving said fastener shanks.

6. The system of claim 1 wherein said strip is compressible, to enhance the seal between said bar and membrane.

7. The system of claim 1 wherein each of said marginal regions of said strip overlies said plurality of fastener heads to provide a double thickness of strip above the fastener heads.

8. The system of claim 1 wherein said marginal regions of said strips are in direct contact with each other in the region of overlap.

9. The system of claim 1 wherein said strip is self-adhering to enhance the seal between said overlapping marginal regions and the attachment of said bar to said membrane.

10. A method of mechanically attaching a waterproof membrane to a roof structure upon which the membrane is positioned, comprising the steps of:

positioning an elongated fastening bar and waterproof strip above the membrane with an intermediate longitudinal region of the strip sandwiched between the bottom of the bar and the membrane and with elongated marginal regions of the strip located on opposite sides of the intermediate region being in non-encircling relation to the bar and in non-underlying relation to the bottom of the bar, driving the shanks of fasteners through the bar and underlying intermediate region of the strip and membrane into the roof structure to position the fastener heads proximate the top of the bar, to anchor the bar to the roof structure with the intermediate region of the strip and underlying membrane sandwiched therebetween, and at least partially overlapping the marginal regions of the strip relative to each other above the bar to encircle the bar and fastener heads with the strip.

11. The method of claim 10 wherein the overlapping step includes overlapping the marginal regions of the strip above the fastener heads to provide a double thickness of strip above the fastener heads.

12. The method of claim 10 wherein the overlapping step includes directly contacting the overlapping portions of the strip relative to each other.

13. The method of claim 10 wherein the strip is compressible and the fastener driving step includes extendnig the fastener shanks sufficiently into the underlying roof structure to compress the strip between the membrane and bar.

14. The method of claim 10 wherein the strip is self-adhering and the positioning step includes adhering the strip to either the membrane or the bottom of the bar prior to driving the fasteners through the bar, strip and membrane into the underlying roof structure.

* * * * *